US007394206B2

(12) United States Patent
Yu et al.

(10) Patent No.: US 7,394,206 B2
(45) Date of Patent: Jul. 1, 2008

(54) ELECTRONIC BALLAST WITH LIFE-ENDED PROTECTION

(75) Inventors: Lufan Yu, Fujian Province (CN); Wenping Xu, Fujian Province (CN)

(73) Assignee: Xiamen Topstar Lighting Co. Ltd., Xiamen, Fujian Province (CN)

( * ) Notice: Subject to any disclaimer, the term of this patent is extended or adjusted under 35 U.S.C. 154(b) by 8 days.

(21) Appl. No.: 10/594,781

(22) PCT Filed: Jan. 26, 2005

(86) PCT No.: PCT/CN2005/000113

§ 371 (c)(1),
(2), (4) Date: Sep. 29, 2006

(87) PCT Pub. No.: WO2005/104629

PCT Pub. Date: Nov. 3, 2005

(65) Prior Publication Data

US 2007/0216321 A1 Sep. 20, 2007

(30) Foreign Application Priority Data

Apr. 27, 2004 (CN) ..... 2004 1 0036723

(51) Int. Cl.
*H05B 37/02* (2006.01)

(52) U.S. Cl. ..... 315/209 R; 315/241 R

(58) Field of Classification Search ..... 315/209 R, 315/219, 221, 223, 224, 225, 226, 241 R, 315/244, 276, 283, 291
See application file for complete search history.

(56) References Cited

U.S. PATENT DOCUMENTS 4,459,516 A * 7/1984 Zelina et al. ..... 315/209 R
5,583,402 A * 12/1996 Moisin et al. ..... 315/307
5,761,056 A 6/1998 Noh ..... 363/132
6,088,249 A * 7/2000 Adamson ..... 363/97

FOREIGN PATENT DOCUMENTS

CN 2267607 Y 11/1997

* cited by examiner

*Primary Examiner*—Thuy Vinh Tran
(74) *Attorney, Agent, or Firm*—Greer, Burns & Crain, Ltd.

(57) ABSTRACT

An electronic ballast includes a rectifier and filter circuit, a DC/AC inverter circuit and a resonant circuit. An input of the rectifier and filter circuit is connected to an outside power supply, its output is connected to the inputs of DC/AC inverter circuit, an output of the DC/AC inverter circuit is connected to inputs of the resonant circuit, and an output of the resonant circuit is connected to a lamp. In addition, a feedback driver circuit and a filament current loop are connected to the lamp at its input. An input of the feedback driver circuit is connected to the filament current loop, and its output is connected to the control terminal of the DC/AC inverter circuit. Electrical signals of the filament current loop control the DC/AC inverter circuit drive the resonant circuit through the feedback driver circuit. The filament capacitor is disconnected from the lamp when the filament is broken.

4 Claims, 1 Drawing Sheet

ELECTRONIC BALLAST WITH LIFE-ENDED PROTECTION

This Application is a National Stage Application filed under 35 U.S.C. 371 claiming the benefit of the international application PCT/CN05/00113, filed on Jan. 26, 2005, having a priority of a China application No. 2004 10036723.3 filed on Apr. 27, 2004.

TECHNICAL FIELD OF THE INVENTION

The invention relates to an electronic ballast, and particularly to an electronic ballast with life-ended protection.

BACKGROUND OF THE INVENTION

Conventional electronic ballasts include a rectifier and filter circuit, a DC/AC inverter circuit, a resonant circuit and the like. At present, however, some ballasts keep on working when the lamp filament is disconnected. During this time, it is possible to break and melt the lamp and thereby cause hydrargyrum leakage, which is a serious hidden danger for safety.

SUMMARY OF THE INVENTION

An object of the invention is to provide an electronic ballast having life-ended protection, which can stop the ballast when the lamp filament is disconnected.

The electronic ballast according to the present invention has a rectifier and filter circuit, a DC/AC inverter circuit and a resonant circuit. An input of the rectifier and filter circuit is connected to an outside power supply, its output is connected to the inputs of DC/AC inverter circuit, an output of the DC/AC inverter circuit is connected to the inputs of resonant circuit, and an output of the resonant circuit is connected to a lamp. The electronic ballast also has a feedback driver circuit and a filament current loop connected to the lamp at its input. An input of the feedback driver circuit is connected to the filament current loop, and its output is connected to the control terminal of the DC/AC inverter circuit. Electrical signals of the filament current loop control the DC/AC inverter circuit to drive the resonant circuit through the feedback driver circuit.

A feedback drive transformer which is connected to the filament current loop at its primary winding and to the input of the DC/AC inverter circuit at its secondary winding is used for the feedback driver circuit.

A filament capacitor loop connected to the input of the feedback driver circuit at its output is used for the filament capacitor circuit.

A filament capacitor loop used for the filament capacitor circuit includes a capacitor and a thermal resistor in parallel. An input of the filament capacitor loop is connected to one end of the lamp, its output is connected to the primary winding of the feedback drive transformer, and an output of the primary winding is connected to the other end of the lamp. The secondary winding of the feedback drive transformer is connected to provide drive power to the bases of the two triodes of the DC/AC inverter circuit, respectively.

The present invention provides a feedback driver system for deriving the filament current from the filament capacitor where the filament capacitor is directly connected to the lamp filament. The filament capacitor is disconnected from the lamp when the filament is broken, thereby stopping the feedback drive immediately. As a result, the DC/AC inverter circuit has no drive power and the system stops operating. It should be appreciated that the above results may still be obtained, even if there are various changes to the circuit, as long as the filament current feedback drive is combined with the circuit.

EMBODIMENTS OF THE INVENTION

Figure 1:
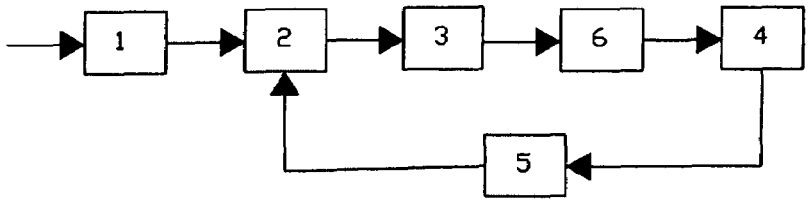
FIG. 1 is a block diagram according to the present invention.

As shown in FIG. 1, the present invention is provided with a rectifier and filter circuit 1, a DC/AC inverter circuit 2, a LC series resonant circuit 3, a filament capacitor circuit 4, and a feedback driver circuit 5. An input of the rectifier and filter circuit 1 is connected to an outside power supply, its output is connected to an input of DC/AC inverter circuit 2, an output of the DC/AC inverter circuit 2 is connected to an input of the LC series resonant circuit 3, an output of the LC series resonant circuit 3 is connected to the lamp 6, the filament capacitor circuit 4 is connected to an input of the feedback driver circuit 5, and an output of the feedback driver circuit 5 is connected to the input of the DC/AC inverter circuit 2.

The feedback driver circuit may use a filament current feedback driver circuit comprised of a feedback drive transformer. The primary winding of the transformer is connected in series with the filament capacitor circuit and its secondary winding is connected to the input of the DC/AC inverter circuit. The embodiments of the present invention is given as follows.

First Embodiment

Figure 2:
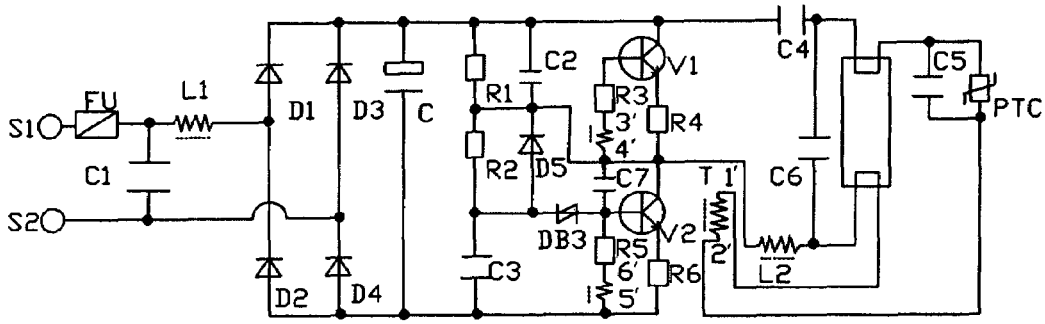
FIG. 2 is a schematic diagram of the first embodiment according to the present invention.

As shown in FIG. 2, S1, S2 are inputs of power sources. The rectifier and filter circuit is composed of a fuse FU, capacitors C and C1, an inductor L1, and rectifier diodes D1, D2, D3, and D4. The DC/AC inverter is composed of triodes V1, V2 and their peripheral devices. The LC series resonant circuit is composed of an inductor L2 and capacitors C4, C6. A capacitor C5 and a thermal resistor PTC connected in parallel are formed into the filament capacitor circuit that is connected to one end of the lamp at its input. The primary winding (primary turns) 1'-2' of the feedback drive transformer T is connected in series with the filament capacitor circuit and is connected to the other end of the lamp, and the secondary windings (secondary turns) 3'-4', 5'-6' are connected to the bases of the triodes V1, V2 of DC/AC inverter circuit for providing them with a drive power, respectively.

When the lamp filament is disconnected, the charging circuit for the capacitor C5 of filament capacitor circuit is turned off, and voltage across the capacitor C5 is approximate equal to 0 due to presence of the thermal resistor PTC. At the same time, the primary winding 1'-2' of the feedback drive transformer T is powered off so as not to drive the secondary windings (secondary turns) 3'-4', 5'-6' connected to the bases of the triodes V1, V2 of DC/AC inverter circuit, thereby causing the system to stop operating. That is, when the lamp's power is terminated (the filament is disconnected) the present invention helps to prevent the breaking and melting of the lamp and the occurrence of hydrargyrum leakage.

Figure 3:
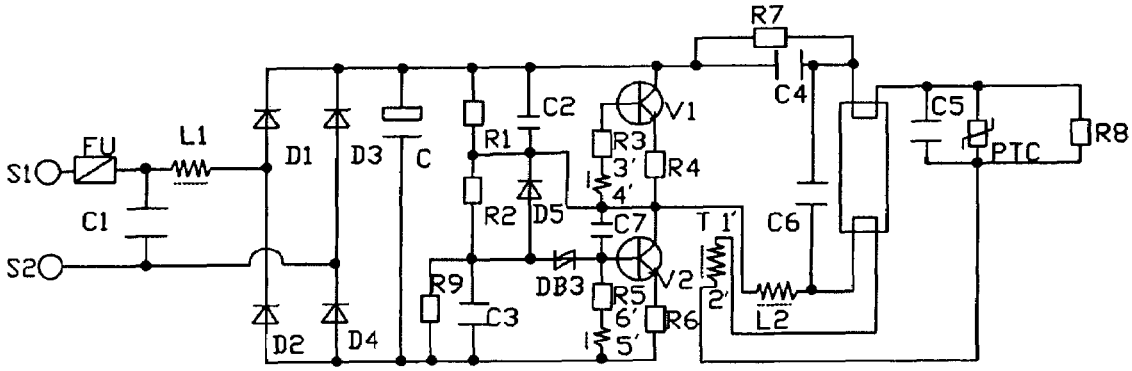
FIG. 3 is a schematic diagram of the second embodiment according to the present invention.

As shown in FIG. 3, the DC/AC inverter circuit 2 is different from the first embodiment. The filament capacitor circuit is comprised of a capacitor C5, a thermal resistor PTC and a resistor 8 connected in parallel. The primary winding (primary turns) 1'-2' of feedback drive transformer T is connected in series with the filament capacitor circuit and is connected to the other end of the lamp, and the secondary windings (secondary turns) 3'-4', 5'-6' are connected to bases of triodes V1, V2 of DC/AC inverter circuit for providing them with a drive power, respectively.

This embodiment uses the electrical signals of filament current loop 4 connected to the DC/AC inverter circuit 2 through the feedback driver circuit 5 to control oscillation of the resonant circuit 3 to obtain life-ended protection. The above embodiments are adaptable to various circuits.

The following are types and parameters of each of the main elements shown in FIG. 2:

Triodes V1, V2: 13003;

Diodes D1-D5: IN4007, DB3:

Resistors R1, R2: 330-680 KΩ; R3, R5: 5-20Ω; R4, R6: 0-1Ω;

Capacitors C1, C4: 22-100 NF; C2, C7: 0.1-2 NF; C3: 22 NF; C5: 1-3 NF; C6: 2-4 NF;

Thermal resistor PTC: 100Ω Φ5.

The following are types and parameters of each main elements shown in FIG. 3

Triodes V1, V2: 13003;

Diodes D1-D5: IN4007;

Resistors R2, R7, R8, R9: 330-680 KΩ; R3, R5: 5-20Ω; R4, R6: 0-1Ω;

Capacitors C1, C4: 22-100 NF; C2, C7: 0.1-2 NF; C3: 22 NF; C5: 1-3 NF; C6: 2-4 NF;

Thermal resistor PTC: 100Ω Φ5.

THE INDUSTRIAL APPLICABILITY

The electronic ballast with life-ended protection according to the present invention is an improvement over the electronic ballast in the prior art. The invention mainly selects the feed back circuit and its signal sample points where the main elements are all standard devices. The manufacture of the ballast is simple, and the ballast has good industrial applicability.

We claim:

1. An electronic ballast with life-ended protection comprising: a rectifier and filter circuit, a DC/AC inverter circuit and a resonant circuit, an input of the rectifier and filter circuit being connected to an outside power supply, an output of said rectifier and filter circuit being connected to an input of the DC/AC inverter circuit, an output of the DC/AC inverter circuit being connected to an input of a resonant circuit, and an output of the resonant circuit being connected to a lamp, a feedback driver circuit and a filament current loop connected to the lamp at an input of said feedback driver circuit, an input of the feedback driver circuit being connected to the filament current loop, an output of said feedback driver circuit being connected to a control terminal of the DC/AC inverter circuit, and a filament capacitor circuit having a filament capacitor loop connected to one end of the lamp at its input and to the input of the feedback driver circuit at its output, electrical signals of the filament current loop controlling the DC/AC inverter circuit to drive the resonant circuit through the feedback driver circuit.

2. The electronic ballast with life-ended protection according to claim 1, wherein the feedback driver circuit further includes a feedback drive transformer connected to the filament current loop at a primary winding of said transformer and to the input of the DC/AC inverter circuit at a secondary winding of said transformer.

3. An electronic ballast with life-ended protection comprising: a rectifier and filter circuit, a DC/AC inverter circuit and a resonant circuit, an input of the rectifier and filter circuit being connected to an outside power supply, an output of said rectifier and filter circuit being connected to an input of the DC/AC inverter circuit, an output of the DC/AC inverter circuit being connected to an input of a resonant circuit, and an output of the resonant circuit being connected to a lamp, a feedback driver circuit and a filament current loop connected to the lamp at an input of said feedback driver circuit, an input of the feedback driver circuit being connected to the filament current loop, current loop, an output of said feedback driver circuit being connected to a control terminal of the DC/AC inverter circuit, a filament capacitor loop used for a lamp filament capacitor circuit includes a capacitor and a thermal resistor in parallel, an input of the filament capacitor loop is connected to one end of the lamp, an output of said loop is connected to the primary winding of a feedback drive transformer, an output of a primary winding is connected to another end of the lamp, a secondary winding of the feedback drive transformer is connected to provide drive power to bases of two triodes of the DC/AC inverter circuit, respectively, electrical signals of the filament current loop controlling the DC/AC inverter circuit to drive the resonant circuit through the feedback driver circuit.

4. An electronic ballast with life-ended protection comprising: a rectifier and filter circuit, a DC/AC inverter circuit and a resonant circuit, an input of the rectifier and filter circuit being connected to an outside power supply, an output of said rectifier and filter circuit being connected to an input of the DC/AC inverter circuit, an output of the DC/AC inverter circuit being connected to an input of a resonant circuit, and an output of the resonant circuit being connected to a lamp, a feedback driver circuit and a filament current loop connected to the lamp at an input of said feedback driver circuit, an input of the feedback driver circuit being connected to the filament current loop, an output of said feedback driver circuit being connected to a control terminal of the DC/AC inverter circuit, the feedback driver circuit including a feedback drive transformer transformer connected to the filament current loop at a primary winding of said transformer and to the input of the DC/AC inverter circuit at a secondary winding of said transformer, a filament capacitor loop used for a lamp filament capacitor circuit includes a capacitor and a thermal resistor in parallel, an input of the filament capacitor loop is connected to one end of the lamp, an output of said loop is connected to the primary winding of the feedback drive transformer, an output of the primary winding is connected to the other end of the lamp, the secondary winding of the feedback drive transformer is connected to provide a drive power to bases of two triodes of the DC/AC inverter circuit, respectively, electrical signals of the filament current loop controlling the DC/AC inverter circuit to drive the resonant circuit through the feedback driver circuit.

* * * * *